US006161794A

United States Patent [19]

Cravatt

[11] Patent Number: 6,161,794

[45] Date of Patent: Dec. 19, 2000

[54] AUXILIARY TISSUE ROLL HOLDER AND DISPENSER

[76] Inventor: Michael Thomas Cravatt, 7335 Brickyard Rd., Molino, Fla. 32577

[21] Appl. No.: 09/280,164

[22] Filed: Mar. 29, 1999

[51] Int. Cl.[7] ..... B65H 19/00

[52] U.S. Cl. ..... 242/560.3; 242/560; 242/561; 242/598.6; 242/595; 312/34.22

[58] Field of Search ..... 242/560, 560.1, 242/560.2, 561, 566, 594, 596.8, 598.3, 598.5, 598.6, 595, 560.3; 312/242, 245, 34.1, 34.8, 34.22, 34.24; D6/518, 519, 520, 523, 575

[56] References Cited

U.S. PATENT DOCUMENTS

| | | | |
|---|---|---|---|
| D. 249,309 | 9/1978 | Williams | D6/520 |
| 1,686,911 | 10/1928 | Fredlund | 242/598.6 X |
| 2,605,975 | 8/1952 | Page et al. | 312/34.22 X |
| 2,993,658 | 7/1961 | Sweeney | 312/34.22 X |
| 3,271,090 | 9/1966 | Smithers | 312/34.22 |
| 3,279,715 | 10/1966 | Vedvig | 242/598.6 X |
| 3,580,651 | 5/1971 | Gauper | 312/34.22 |
| 3,598,331 | 8/1971 | Okamura | 312/34.22 X |
| 4,108,389 | 8/1978 | Womack | 312/34.22 X |
| 4,564,148 | 1/1986 | Wentworth | 242/598.3 X |
| 5,765,719 | 6/1998 | Upham et al. | 242/560 X |

*Primary Examiner*—Donald P. Walsh
*Assistant Examiner*—William A. Rivera
*Attorney, Agent, or Firm*—Peter Loffler

[57] ABSTRACT

An auxiliary roll dispenser has a body member with opposing side walls joined by a back member, a top member, and a bottom member and a discharge opening. A pair of opposing extensions extend outwardly from the side members proximate the discharge opening. A spindle is positioned between the extensions. A main panel is pivotally secured to the body member while a top panel is pivotally secured to the main panel. A dispensing mechanism has an angled dispensing plate, having an upper portion and a lower portion, pivotally attached to the main panel, a knob protruding through an aperture and connected to the lower portion, and a spring having one end abutting the main panel and the opposing end abutting the lower portion.

7 Claims, 5 Drawing Sheets

20
10
"12"
"14"
42
38
34
30
36
32
46
24
26

AUXILIARY TISSUE ROLL HOLDER AND DISPENSER

BACKGROUND OF THE INVENTION

1. Field of the Invention

The present invention relates to a device adapted to hold a plurality of rolls of tissue such as toilet tissue and the like and is capable of feeding a new roll of tissue into a dispensing position upon the exhaustion of the previous roll.

2. Background of the Prior Art

The need to have an additional roll of paper tissue in a toilet setting is very evident. After one roll expires, a user of the toilet may require an additional roll. Recognizing the utility of providing for one or more additional rolls of tissue in a toilet setting has been recognized in the art. Many devices have been proposed to discharge a roll of tissue whenever the original roll of tissue has been exhausted. The devices known in the art address the utility aspects of a multiple roll dispenser—to dispense a secondary roll of tissue whenever the primary roll is exhausted. The devices, many of which perform their desired task in an appropriate and efficient manner, lack any redeeming aesthetic factors. These devices are designed to work without regard as to how they look. Furthermore, many such prior art devices, being designed for implementation in a commercial setting, are relatively complex in design, operation, and are inefficient in space utilization.

Therefore, there is a need in the art for a multiple roll dispenser that overcomes the above-stated shortcomings in the art. Such a dispenser must be able to quickly and efficiently discharge a roll of tissue whenever the prior roll is exhausted. Such dispension must be performed relatively easily. The device should be space-efficient and must be able to be configured so as to provide aesthetic qualities to its surrounding environment.

SUMMARY OF THE INVENTION

The auxiliary roll holder of the present invention addresses the aforementioned needs in the art. The auxiliary roll holder is comprised of a tube-like body member having a pair of opposing side members integrally joined by a back member, a top member, and a bottom member. A main panel is hingedly attached to the body member while a top panel is hingedly attached to the main panel. A discharge opening is located within the body member proximate the bottom member, below the main panel. A pair of extensions, having a spindle rotatably secured therebetween, extend outwardly from the bottom member proximate the opening.

A dispensing mechanism is attached to the main panel and is comprised of a dispensing plate having an upper portion and a lower portion separated by an obtuse angle, pivotally attached to the main panel. A knob, having one end adapted for gripping, extends through an aperture on the main panel and is connected to the lower portion of the dispensing plate. A spring has one end abutting the main panel and an opposing end butting the lower portion of the dispensing plate.

A tissue roll is impaled on the spindle and the spindle is received between the extensions. Once this roll is exhausted, another roll is presented in order to be placed onto the spindle. To effect this presentation, the knob is pulled outwardly causing the upper portion to catch the stored upper roll. Meanwhile, the lower portion goes generally flush with the main panel causing the next roll to drop into the discharge opening. Once the knob is released, the spring causes the lower portion to extend into the channel causing the lower portion to catch the upper roll.

The device is of relatively simple design and construction, and is simple to use and maintain. The device is positionable within an appropriate opening within a wall, having an encompassing flange to properly position the device.

BRIEF DESCRIPTION OF THE DRAWINGS

Similar reference numerals refer to similar parts throughout the several views of the drawings.

DESCRIPTION OF THE PREFERRED EMBODIMENT

Figure 1:
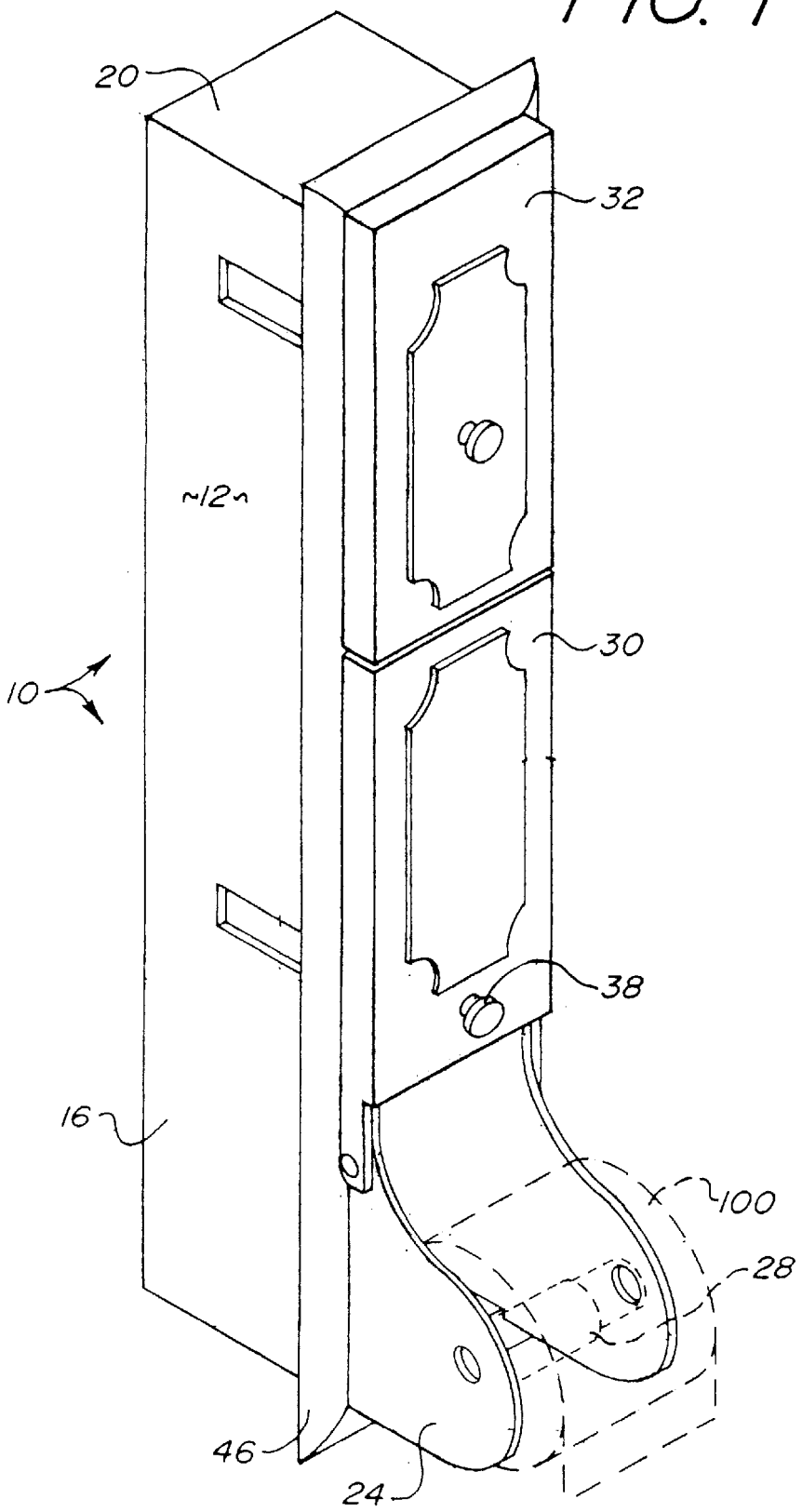
FIG. 1 is a perspective view of the auxiliary roll holder of the present invention.
Figure 2:
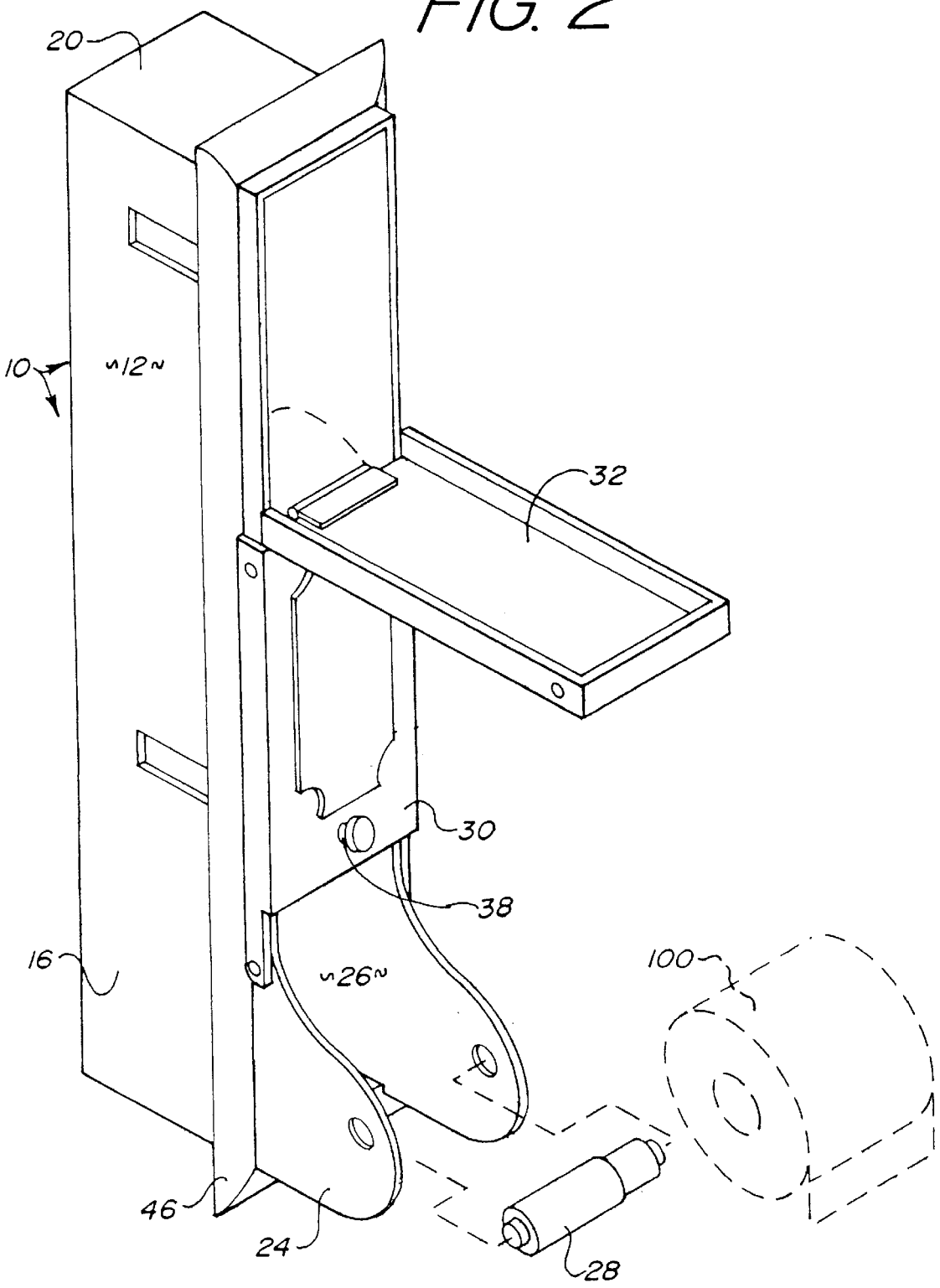
FIG. 2 is a perspective view of the auxiliary roll holder with the top panel hinged open.
Figure 3:
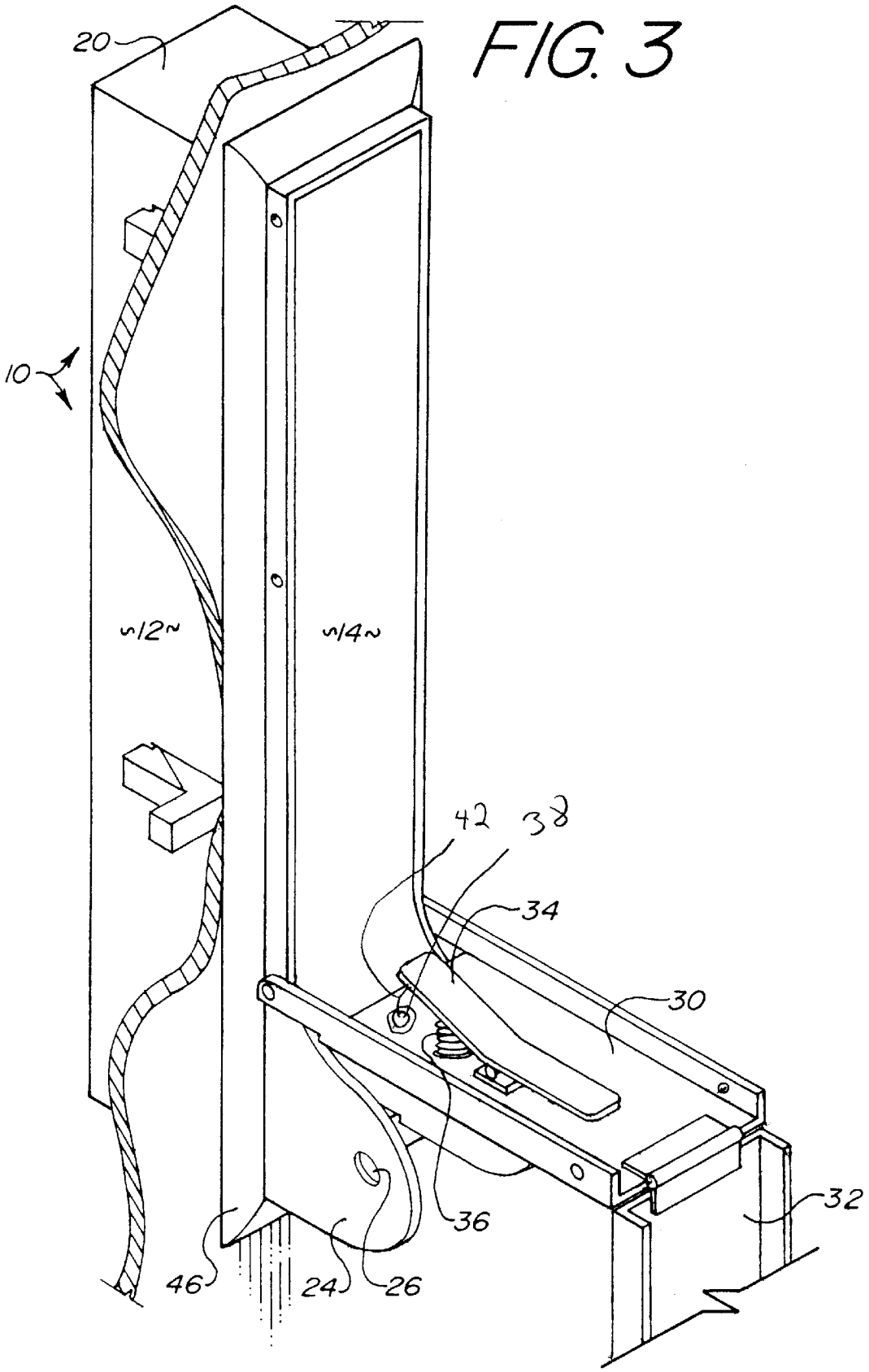
FIG. 3 is a perspective view of the auxiliary roll holder with the main panel hinged open.

Referring now to the drawings, it is seen that the auxiliary roll holder, generally denoted by reference numeral 10, is comprised of a rectangular tube-like body member 12. As seen, the body member 12 delimits a channel 14 and is comprised of a pair of opposing side members 16 integrally joined by a back member 18, a top member 20, and a bottom member 22. A pair of extensions 24 extend outwardly from the body member 12 proximate the bottom member 22 and a discharge opening 26 to the channel 14 exists between the extensions 24. Removably disposed between the pair of extensions 24 is a roll spindle 28 of any appropriate design. A front panel is comprised of a main panel 30 hingedly secured to the body member 12 and a top panel 32 hingedly secured to the main panel 30.

Figure 4:
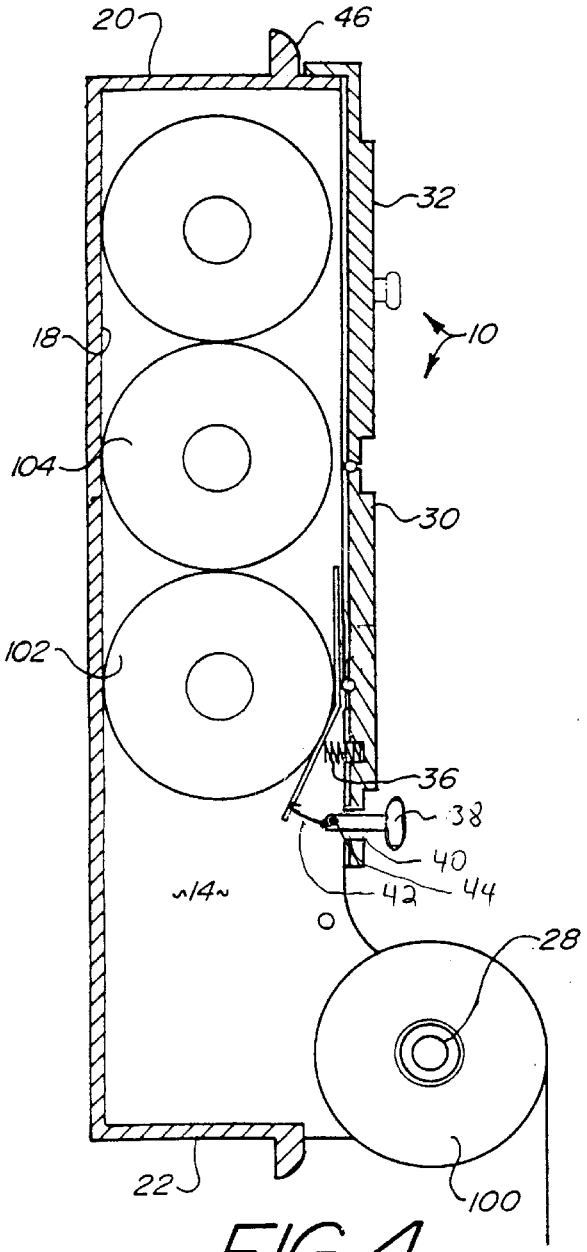
FIGS. 4–6 illustrate the articulating action of the dispenser mechanism utilized with the auxiliary roll holder of the present invention.
Figure 5:
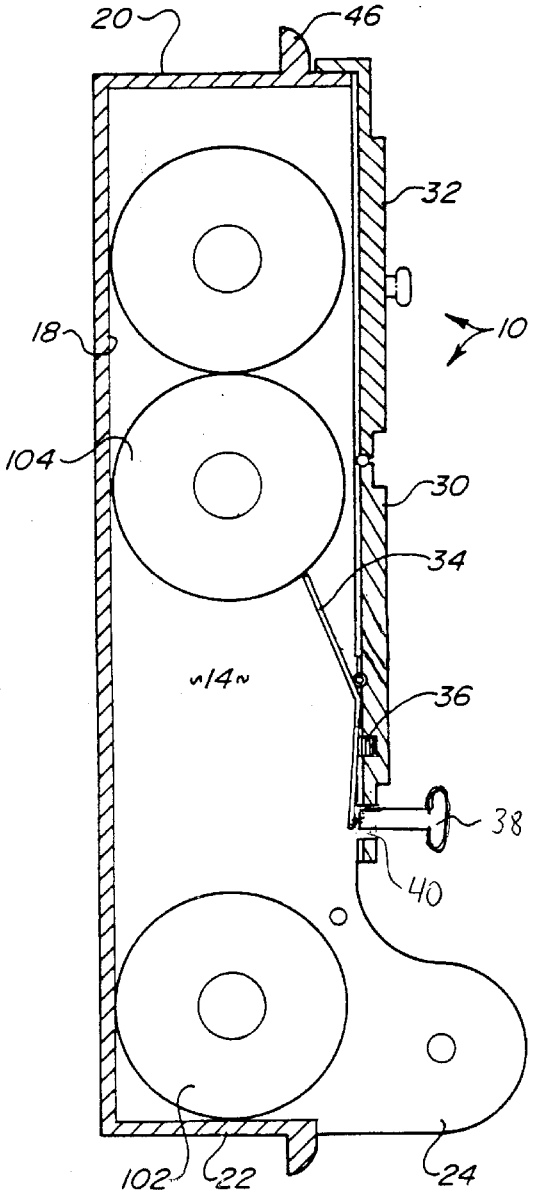
Figure 6:
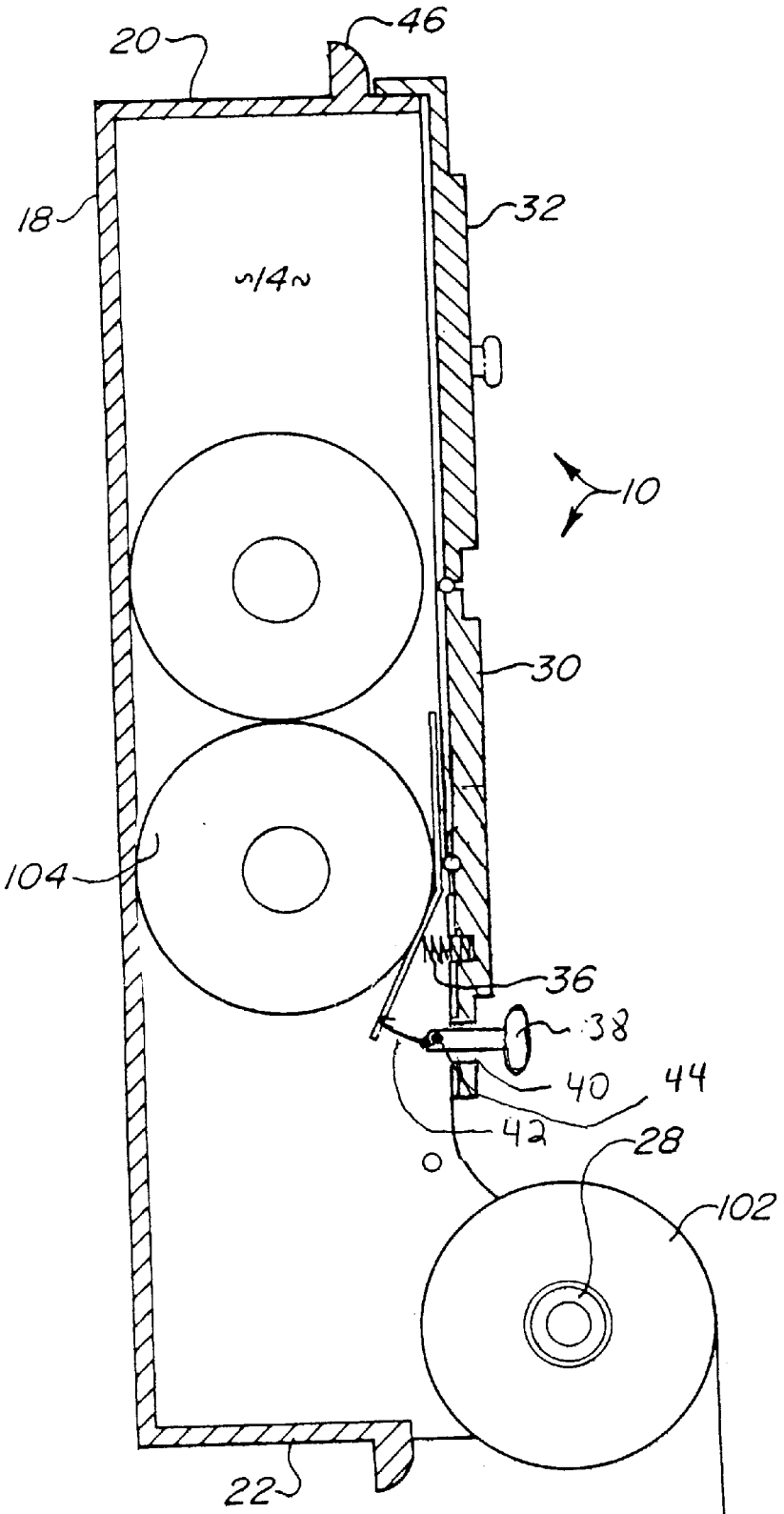

As seen in FIGS. 4–6, a dispensing mechanism is attached to the main panel 30. The dispensing mechanism is comprised of an angled dispensing plate 34 pivotally attached to the inner face of the main panel 30. As seen, the dispensing plate 34 is an angled member having an upper portion and a lower portion and having an obtuse angle formed between the upper portion and the lower portion. A spring 36 has one end disposed within an opening within the main panel 30 and has an opposing end protruding into the channel 14 proximate the lower portion of the dispensing plate 34. A knob 38 is adapted to slide within an aperture 40 on the main panel 30 and has a gripping end disposed exterior of the main panel 30 and an opposing end protruding into the channel 14. The knob 38 is connected to the lower portion of the dispensing plate 34 by an appropriate connecting device 42 such as a rod or a wire. A small protrusion 44 located near the end of the knob 38 prevents over-extraction of the knob 38 from the device 10.

In order to utilize the auxiliary roll holder 10 of the present invention, the body member 12 is affixed to an appropriate surface. Advantageously, the body member 12 is disposed within an opening within a wall of a room and held therein by any appropriate means. A flange 46 surrounds the outer periphery of the body member 12. The flange 46 is disposed in a plane that is generally parallel to the plane of the front panel and properly positions and prevents over insertion of the body member 12 within the opening in the wall. A tissue roll 100 is impaled by the spindle 28 and the spindle 28 is positioned within the pair of extensions 24.

This tissue roll 100 is ready for tissue dispension. The top panel 32 is hingedly swung open to permit access to the channel 14 therein. At least one tissue roll is loaded into the device 10 via the opening produced by swinging the top panel 32 open. Once the at least one tissue roll is loaded, the top panel 32 is swung closed. The top panel 32 is frictionally held in a closed position, or, alternately is held in a closed position by appropriate latching mechanism (not illustrated).

As seen in FIG. 4, in the dispensing mechanism's normally relaxed state, the dispensing plate's lower portion extends into the channel 14 and holds the tissue roll 102 thereby and prevents this roll 102 from dropping. The upper portion of the dispensing plate 34 is generally flush with the main panel 30. The knob 38 is in its fully withdrawn state so as to permit the above-described flush positioning of the upper portion of the dispensing plate 34. The spring 36 is in its extended state having one end abutting the main panel 30 and the opposing end abutting the lower portion of the dispensing plate 34 and maintaining the lower portion in its extended position into the channel 14.

Upon exhaustion of the initial tissue roll 100, a new roll must be fed into the discharge opening 26 bordered by the extensions 24. In order to feed a new roll thereinto, the knob 38 is pulled outwardly, pulling on the lower portion of the dispensing plate and causing the dispensing plate 34 to pivot such that its upper portion extends into the channel 14 and its lower portion is generally flush with the main panel 34. This causes the lowermost roll 102 to gravitationally drop and be available through the discharge opening 26 between the extensions 24. The spindle 28 prevents this roll 102 from dropping to the ground. This roll 102 is impaled by the spindle 28, the spindle 28 is properly positioned, and the roll 102 is ready for dispension. Coincidentally, the extended upper portion of the dispensing plate 34 prevents the next upper roll 104 from dropping.

Thereafter, the knob 38 is released, and the upper portion of the dispensing plate 34, through the loading action of the spring 36, is positioned flush with the main panel 30. This permits the next roll 104 to drop downwardly. The pivoting dispensing plate 34, caused by the spring 36, causes the dispensing plate's lower portion to extend into the channel 14 thereby catching the next roll 104 and preventing its further drop. The device 10 is again ready for use.

In order to gain service access to the interior of the device 10, the main panel 30 is swung open. After servicing, the main panel 30 is swung closed.

While the invention has been particularly shown and described with reference to an embodiment thereof, it will be appreciated by those skilled in the art that various changes in form and detail may be made without departing from the spirit and scope of the invention.

I claim:

1. An auxiliary roll holder comprising:

a tube adapted to hold a stack of rolls, the tube having a discharge opening at a lower end of the tube, a pair of generally coextensive extensions extending outwardly from the tube proximate the discharge opening, and a front panel hingedly attached to the tube;

a spindle adapted to be received between the pair of extensions;

an angled plate, having a lower portion and an upper portion, pivotally attached to the inner surface of the front panel;

a knob, having a first end extending into the tube through an aperture on the front panel and connected to the lower portion of the angled plate and a second end located exterior of the tube, wherein the second end of the knob is rigid;

a spring having a first end extending into the tube generally abutting the lower portion of the angled plate and a second end received within a recessed portion within the front panel; and wherein when the auxiliary roll holder is in a normally relaxed state, the upper portion of the angled plate is generally flush with the front panel, the knob is in a fully retracted state and the lower portion of the angled plate is angled into the interior of the tube, and upon pulling of the knob the upper portion of the angled plate extends into the interior of the tube and the lower portion of the angled plate is generally flush with the front panel and is depressing the spring.

2. The auxiliary roll holder as in claim 1 wherein the front panel is comprised of a pair of panels hingedly attached to each other.

3. The auxiliary roll holder as in claim 2 further comprising a protrusion on the first end of the knob.

4. The auxiliary roll holder as in claim 1 further comprising a flange on the outer periphery of the tube, the flange located in a plane that is generally parallel to a plane within which the front panel is disposed.

5. An auxiliary roll holder consisting essentially of:

a tube adapted to hold a stack of rolls, the tube having a discharge opening at a lower end of the tube, a pair of generally coextensive extensions extending outwardly from the tube proximate the discharge opening, and a front panel hingedly attached to the tube;

a spindle adapted to be received between the pair of extensions;

an angled plate, having a lower portion and an upper portion, pivotally attached to the inner surface of the front panel;

a knob, having a first end extending into the tube through an aperture on the front panel and connected to the lower portion of the angled plate and a second end located exterior of the tube;

a spring having a first end extending into the tube generally abutting the lower portion of the angled plate and a second end received within a recessed portion within the front panel; and wherein when the auxiliary roll holder is in a normally relaxed state, the upper portion of the angled plate is generally flush with the front panel, the knob is in a fully retracted state and the lower portion of the angled plate is angled into the interior of the tube, and upon pulling of the knob the upper portion of the angled plate extends into the interior of the tube and the lower portion of the angled plate is generally flush with the front panel and is depressing the spring.

6. The auxiliary roll holder as in claim 5 wherein the front panel is comprised of a pair of panels hingedly attached to each other.

7. The auxiliary roll holder as in claim 5 wherein the second end of the knob is rigid.

* * * * *